US012208941B2

(12) United States Patent
Lane et al.

(10) Patent No.: US 12,208,941 B2
(45) Date of Patent: Jan. 28, 2025

(54) CONTAINER GRIP PANEL WITH IMPROVED SIDE LOAD

(71) Applicant: AMCOR RIGID PACKAGING USA, LLC, Ann Arbor, MI (US)

(72) Inventors: Michael T. Lane, Brooklyn, MI (US); James Stelzer, South Lyon, MI (US); Omkar Dole, Ann Arbor, MI (US); Dan Witham, Sylvania, OH (US); Luke A. Mast, Brooklyn, MI (US)

(73) Assignee: AMCOR RIGID PACKAGING USA, LLC, Ann Arbor, MI (US)

( * ) Notice: Subject to any disclaimer, the term of this patent is extended or adjusted under 35 U.S.C. 154(b) by 80 days.

(21) Appl. No.: 17/425,506

(22) PCT Filed: Jan. 29, 2019

(86) PCT No.: PCT/US2019/015614
§ 371 (c)(1),
(2) Date: Jul. 23, 2021

(87) PCT Pub. No.: WO2020/159479
PCT Pub. Date: Aug. 6, 2020

(65) Prior Publication Data

US 2022/0097912 A1 Mar. 31, 2022

(51) Int. Cl.
*B65D 23/10* (2006.01)
*B65D 1/02* (2006.01)
*B65D 1/42* (2006.01)

(52) U.S. Cl.
CPC ..... *B65D 23/102* (2013.01); *B65D 1/0223* (2013.01); *B65D 1/0246* (2013.01);
(Continued)

(58) Field of Classification Search
CPC ..... B65D 1/0223; B65D 1/42; B65D 1/44; B65D 23/102; B65D 2501/0036
See application file for complete search history.

(56) References Cited

U.S. PATENT DOCUMENTS 5,054,632 A 10/1991 Alberghini et al.
5,971,184 A * 10/1999 Krishnakumar ..... B65D 23/102 220/675

(Continued)

FOREIGN PATENT DOCUMENTS

CO 4290503 A1 4/1996
EP 3917849 A1 12/2021

(Continued)

OTHER PUBLICATIONS

International Search Report and Written Opinion of the ISA issued in PCT/US2019/015614, mailed Oct. 29, 2019; ISA/KR.

(Continued)

*Primary Examiner* — Nathan J Jenness
*Assistant Examiner* — Jennifer Castriotta
(74) *Attorney, Agent, or Firm* — Harness, Dickey & Pierce, P.L.C.

(57) ABSTRACT

A polymeric container including a finish defining an opening. A base is configured to support the container upright. A grip area is between the opening and the base. A plurality of grip panels are at the grip area. Each one of the grip panels has a depth, a height, and a width. The depth is at least 17% of the height, and the depth is at least 10% of the width.

14 Claims, 9 Drawing Sheets

(52) U.S. Cl.
CPC ..... *B65D 1/0284* (2013.01); *B65D 1/42* (2013.01); *B65D 2501/0036* (2013.01)

(56) References Cited

U.S. PATENT DOCUMENTS 5,988,417 A * 11/1999 Cheng ..... B65D 1/0223 220/675
6,497,333 B1 * 12/2002 Ellis ..... B65D 1/0223 215/383
6,857,531 B2 2/2005 Slat et al.
6,875,201 B1 * 4/2005 Kawashima ..... B65D 23/102 215/381
7,243,808 B2 * 7/2007 Livingston ..... B65D 1/0223 220/666
D551,984 S * 10/2007 La Kier ..... D9/538
7,296,701 B2 * 11/2007 Ozawa ..... B65D 1/0223 220/666
7,748,552 B2 * 7/2010 Livingston ..... B65D 1/0223 220/666
2002/0096486 A1 7/2002 Bourque et al.
2004/0144748 A1 * 7/2004 Slat ..... B65D 1/0284 215/382
2006/0070976 A1 4/2006 Ungrady
2006/0091102 A1 5/2006 Bourque et al.
2008/0017604 A1 1/2008 Livingston et al.
2008/0110853 A1 5/2008 Toms
2009/0321384 A1 12/2009 Zhang et al.
2010/0301003 A1 12/2010 Lewis et al.
2013/0240540 A1 9/2013 Heisner et al.
2015/0284128 A1 10/2015 Kelley et al.
2016/0176605 A1 6/2016 Pritchett et al.
2019/0047741 A1 2/2019 Lane et al.
2020/0095052 A1 * 3/2020 Singer ..... B65D 1/0223

FOREIGN PATENT DOCUMENTS

JP 5945492 B2 7/2016
WO 2020159479 A1 8/2020

OTHER PUBLICATIONS

Search Report issued in corresponding European Patent Application No. 19913345.5 dated Aug. 9, 2022.
Office Action issued in corresponding Colombian Patent Application NC2021/0010394 dated May 26, 2023.
Canadian Office Action regarding Patent Application No. 3,127,184, dated Feb. 8, 2024.

* cited by examiner

| Container | Volume | Height mm | Width mm | Depth mm | H/W % | D/H% | D/W % |
|---|---|---|---|---|---|---|---|
| 1 | 20oz | 21 | 35 | 4 | 61 | 17 | 10 |
| 2 | 28oz | 24 | 42 | 5 | 56 | 19 | 11 |
| 3 | 32oz | 27 | 42 | 5 | 64 | 17 | 11 |
| 4 | 32oz | 27 | 42 | 5 | 64 | 17 | 11 |
| Range | | | | | 55-65 | 16-18 | 9-10 |

FIG - 9

CONTAINER GRIP PANEL WITH IMPROVED SIDE LOAD

CROSS-REFERENCE TO RELATED APPLICATIONS

This application is a U.S. National Phase Application under 35 U.S.C. 371 of International Application No. PCT/US2019/015614, filed on Jan. 29, 2019. The entire disclosure of the above application is incorporated herein by reference.

FIELD

The present disclosure relates to a polymeric container having grip panels that improve side load performance of the container.

BACKGROUND

This section provides background information related to the present disclosure, which is not necessarily prior art.

Polymeric containers, such as polyethylene terephthalate (PET) containers, must withstand numerous forces incurred during filling, capping, conveying, cooling, labeling, handling, transportation, and storage. Throughout theses stages, the containers are subjected to "side-load" or "point-load" forces that may cause denting and/or deformation in the sides of the containers resulting in undesirable defects in visual and/or functional performance. One way to quantify the design and quality of polymeric containers is measuring resistance to point-loading. Point-load testing evaluates a container's structural resistance to a compressive load applied to contact points of the container, such as sidewall panels, to the point of deformation or collapse. Point-load testing is used to ensure container integrity, and to eliminate material excess while maintaining quality—a process known as "light-weighting."

Some existing containers include a grip design intended to facilitate grasping and holding of the container. While existing container grips are suitable for their intended use, they are subject to improvement. For example, existing container grips may not adequately resist denting and crushing in the grip area. The present disclosure advantageously includes polymeric containers having improved grip areas that provide an increase in point-load strength, thus making the grip areas of the present disclosure more resistant to denting and crushing, as compared to existing containers. The present disclosure provides numerous additional advantages and unexpected results, as explained in detail herein and as one skilled in the art will appreciate.

SUMMARY

This section provides a general summary of the disclosure, and is not a comprehensive disclosure of its full scope or all of its features.

The present disclosure includes a polymeric container having a finish defining an opening. A base is configured to support the container upright. A grip area is between the opening and the base. A plurality of grip panels are at the grip area. Each one of the grip panels has a depth, a height, and a width. The depth is at least 17% of the height, and the depth is at least 10% of the width.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIG. 9 illustrates dimensions of exemplary containers according to the present disclosure.

Corresponding reference numerals indicate corresponding parts throughout the several views of the drawings.

DETAILED DESCRIPTION

Example embodiments will now be described more fully with reference to the accompanying drawings.

Figure 1:
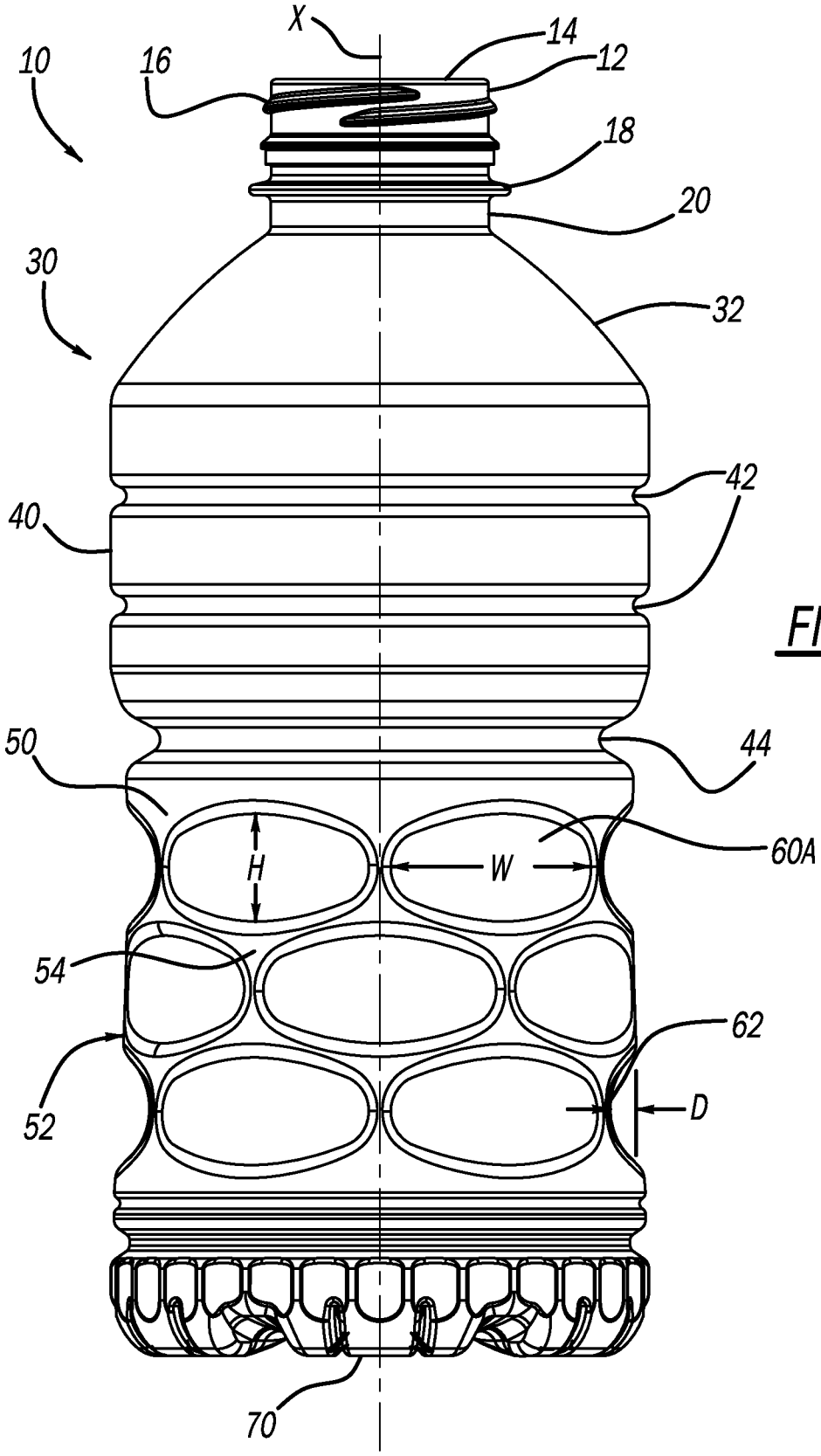
FIG. 1 illustrates a container including a grip area with staggered oval grip panels in accordance with the present disclosure.

FIG. 1 illustrates a polymeric container in accordance with the present disclosure at reference numeral 10. The container 10 may be made of any suitable polymeric material, such as polyethylene terephthalate (PET), low-density polypropylene (LDPP), high-density polyethylene (HDPE), polypropylene, and polystyrene, for example. The container 10 is formed from a preform, such as by any suitable blow-molding process. The container 10 is configured to store any suitable commodity, such as any suitable hot-fill commodity. Exemplary hot-fill commodities include, but are not limited to, any suitable liquid (e.g., energy drinks, sport drinks, sport supplements, etc.) or any suitable food commodity. The container 10 may have any suitable interior volume, such as 20-32 ounces.

The container 10 includes a finish 12, which defines an opening 14 of the container 10. Extending from an exterior of the finish 12 are threads 16. The threads 16 are configured to cooperate with any suitable closure to close the opening 14. Extending from an exterior of the finish 12 proximate to the threads 16 is a flange 18, which may be used to support the preform during blow-molding of the container 10.

Beneath the flange 18 is a neck 20. A dome 30 extends downward and outward from the neck 20, and defines a shoulder 32 of the container 10. Extending from the dome 30 is an upper body portion 40. The upper body portion 40 defines upper ribs 42. Beneath the upper body portion 40 is an intermediate rib 44.

Extending from the upper body portion 40 is a lower body portion 50. The lower body portion 50 extends to a base 70, which is configured to support the container 10 upright when seated on a suitable support surface. The base 70 is a vacuum-absorbing base. Suitable vacuum-absorbing bases include, but are not limited to, any of the vacuum-absorbing bases disclosed in U.S. patent application Ser. No. 16/164,190 titled "Lightweight Container Base" (filed on Oct. 18, 2018), as well as any of the container bases disclosed in the patents and patent applications related to U.S. patent application Ser. No. 16/164,190, each of which is incorporated herein by reference. A longitudinal axis X extends through an axial center of the opening 14, the finish 12, the dome 30, the upper body portion 40, the lower body portion 50, and the base 70.

Figure 2:
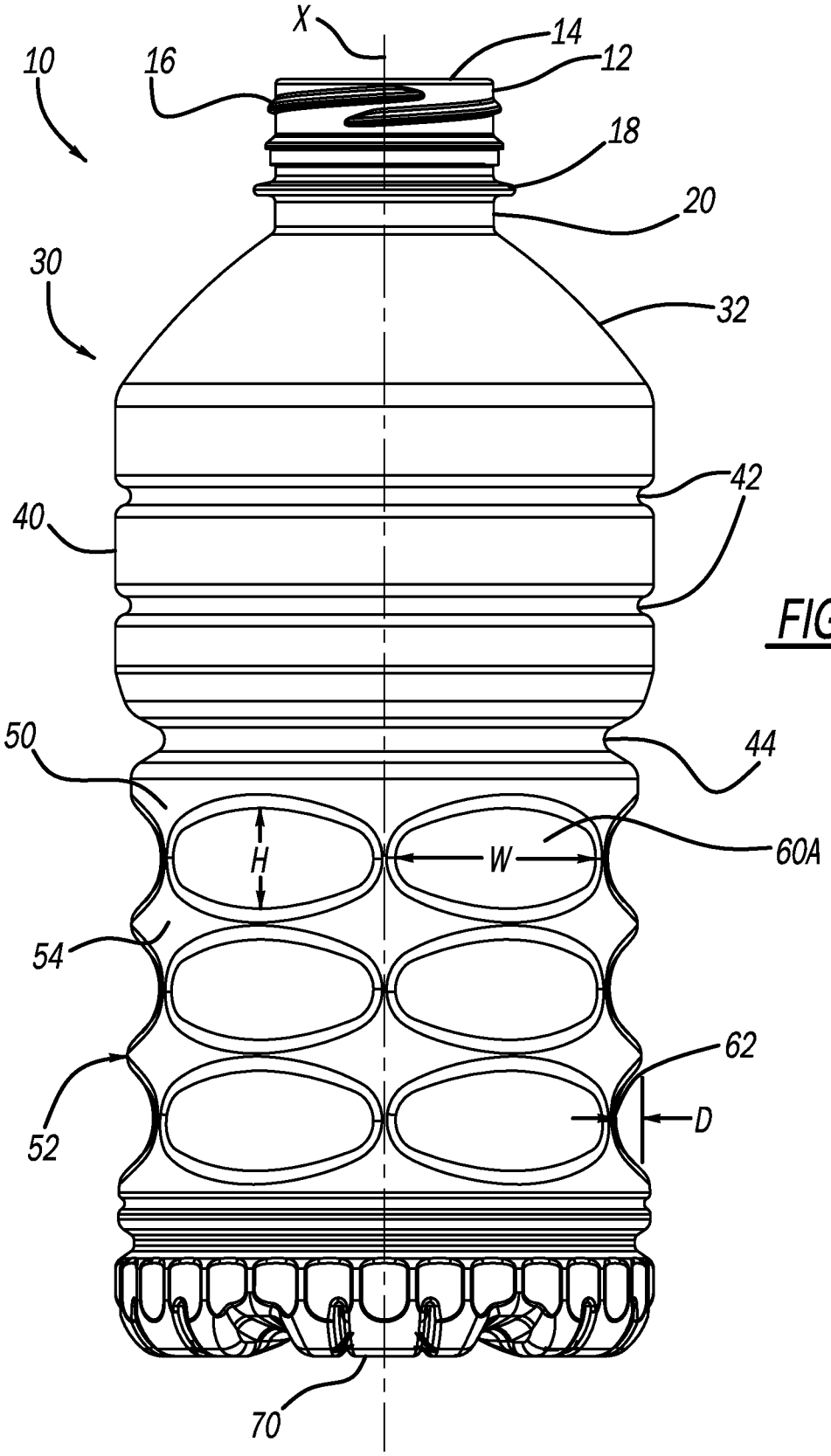
FIG. 2 illustrates a container including vertically aligned oval grip panels in accordance with the present disclosure.

The lower body portion 50 includes a grip area 52. The grip area 52 includes a plurality of grip panels 60A, each of which is surrounded by a border 54. The grip panel 60A may have any suitable shape, such as any suitable polygonal shape. In the example of FIGS. 1 and 2, the grip panels 60A have an oval shape. Other suitable shapes include, but are not limited to, octagonal, rectangular (see FIGS. 3 and 4 at 60B), and polygonal (see FIGS. 5 and 6 at 60C).

Each one of the grip panels 60A, 60B, and 60C have a height H, a width W, and a depth D. The depth D is a distance that the grip panels 60A are recessed beneath the border 54, which is at an outermost surface of the lower body portion 50. Each grip panel 60A includes a continuous radius surface 62, which continuously curves from the border 54 inward to a bottom or deepest portion of the grip panels 68A, 68B, 68C. The depth D is measured from the border 54 to the bottom or deepest portion of the grip panel.

The height H of each one of the grip panels 60A is about 55%-65% (or less than 65%) of the width W. The depth D of each one of the grip panels 60A is about 17%-19% (or greater than 17%) of the height H. Each one of the grip panels 60A has a depth D that is 10%-11% of the width W. The grip panels 60B and 60C have the same height H, depth D, and width W ratios as the grip panels 60A. FIG. 9 illustrates exemplary dimensions of various containers 10 in accordance with the present disclosure.

Figure 3:
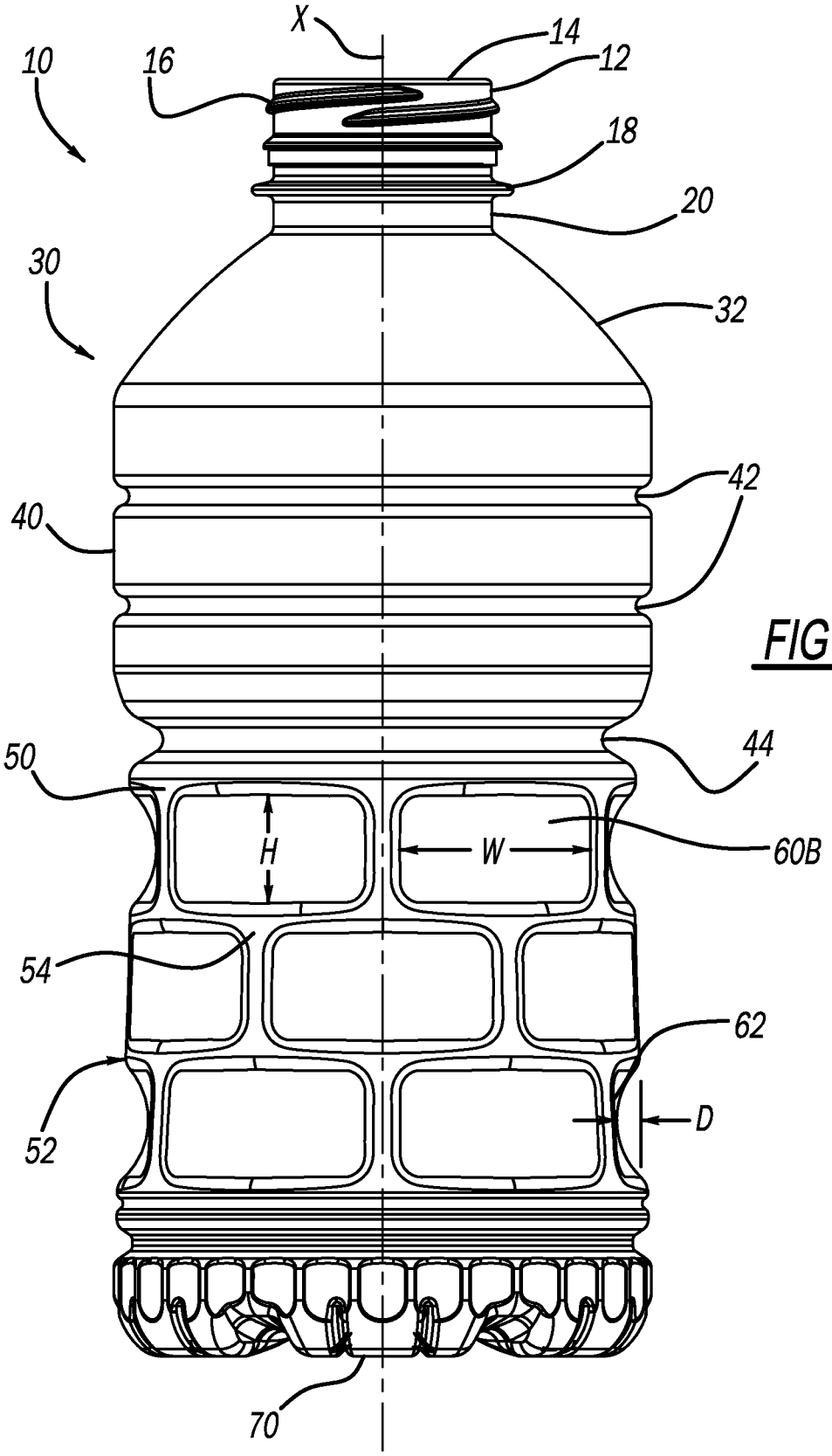
FIG. 3 illustrates a container including a grip area having staggered rectangular grip panels in accordance with the present disclosure.
Figure 4:
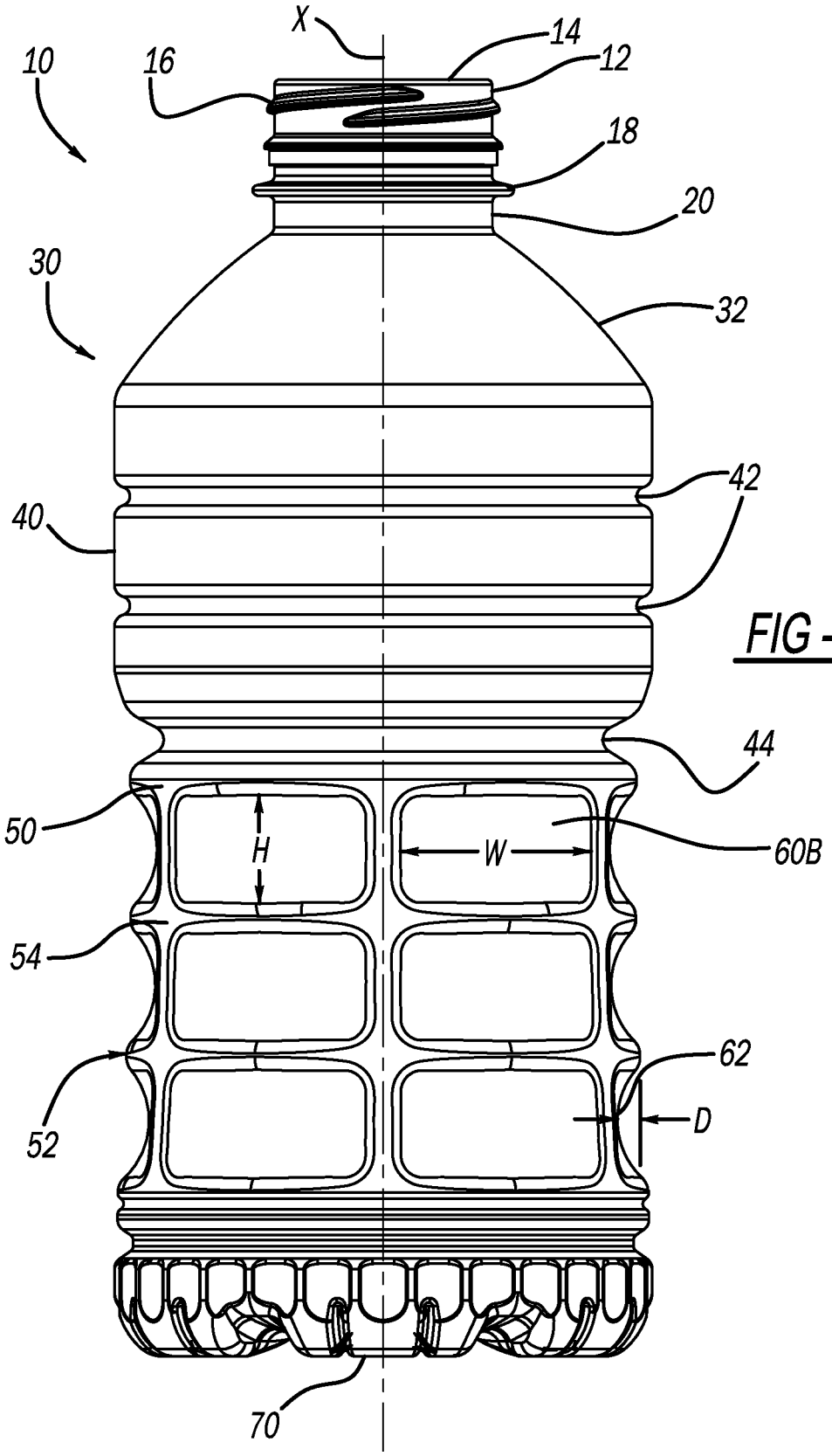
FIG. 4 illustrates a container including a grip area having vertically aligned rectangular grip panels in accordance with the present disclosure.
Figure 5:
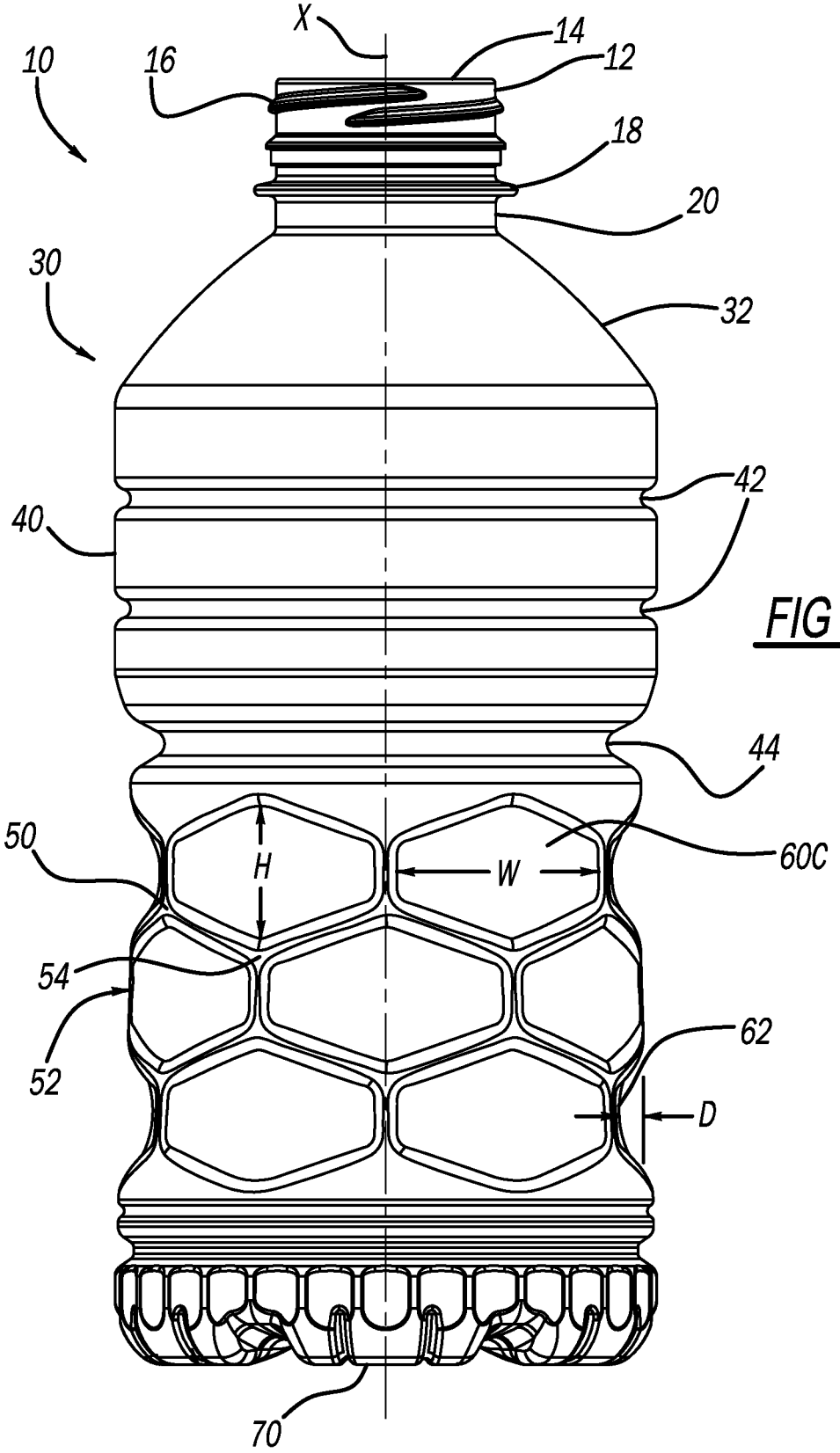
FIG. 5 illustrates a container including a grip area having staggered polygonal grip panels in accordance with the present disclosure.
Figure 6:
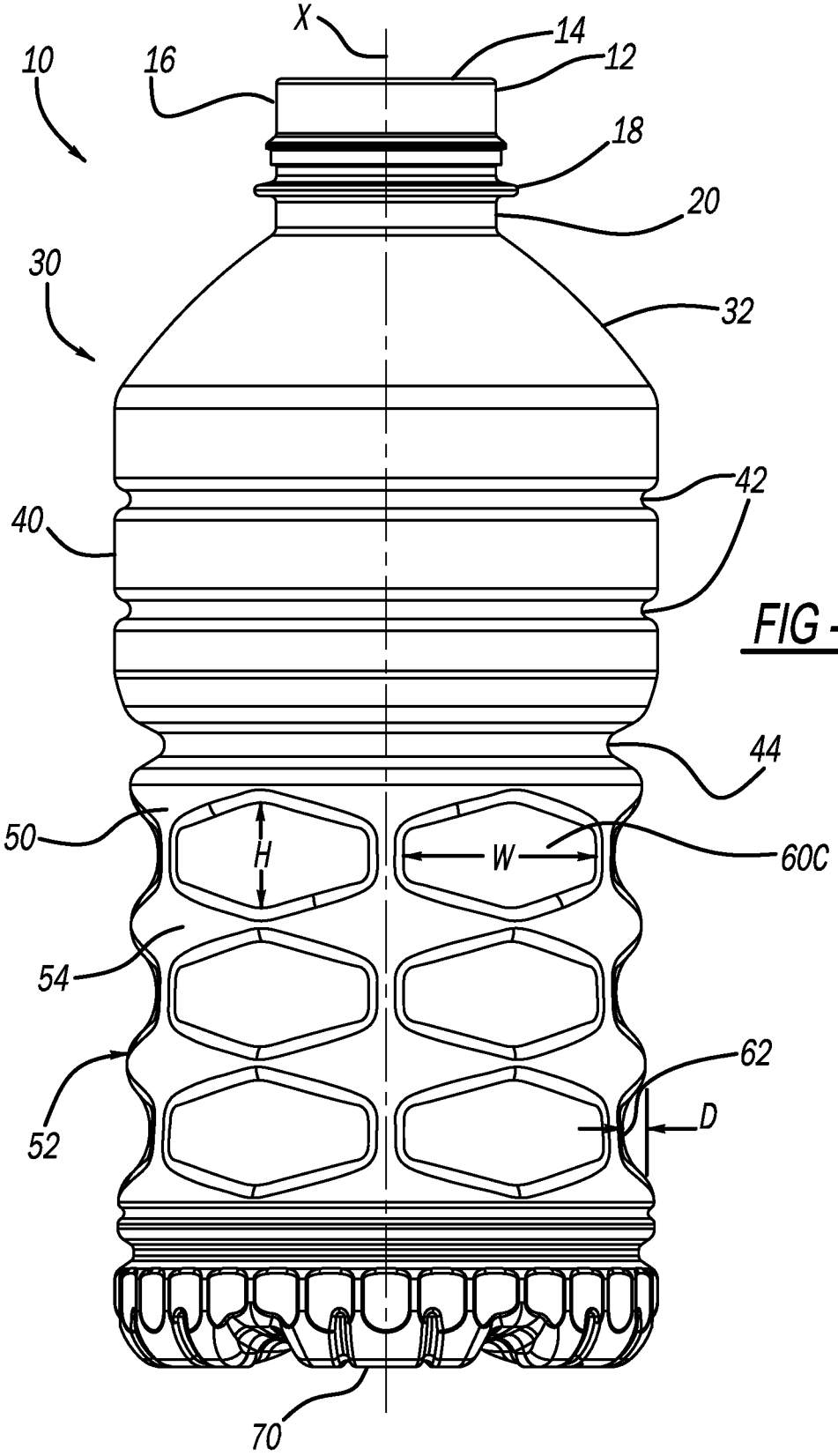
FIG. 6 illustrates a container including a grip area having vertically aligned polygonal grip panels in accordance with the present disclosure.

The grip panels 60A, 60B, and 60C are arranged in rows that extend around the outer circumference of the grip area 52. Any suitable number of rows may be included, such as 2-5 rows. Each row may include any suitable number of grip panels 60A, 60B, or 60C, such as 5-7 grips per row extending about the circumference. The grip panels 60A, 60B, and 60C may be vertically staggered, such as illustrated in FIGS. 1, 3, and 5. Alternatively, the grip panels 60A, 60B, and 60C may be vertically aligned, as illustrated in FIGS. 2, 4, and 6.

Figure 7:
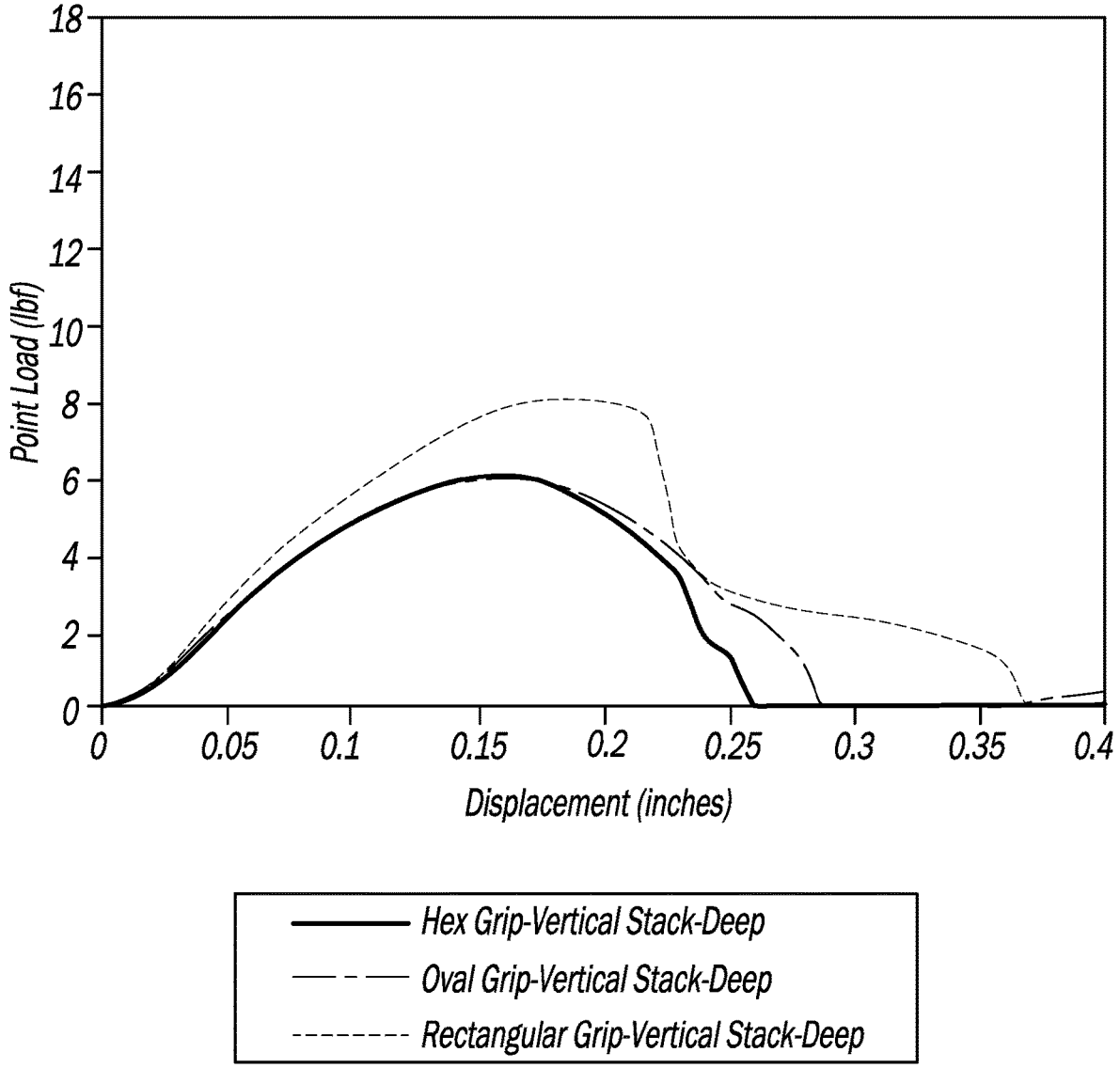
FIG. 7 illustrates point-load performance of exemplary containers of the present disclosure.
Figure 8:
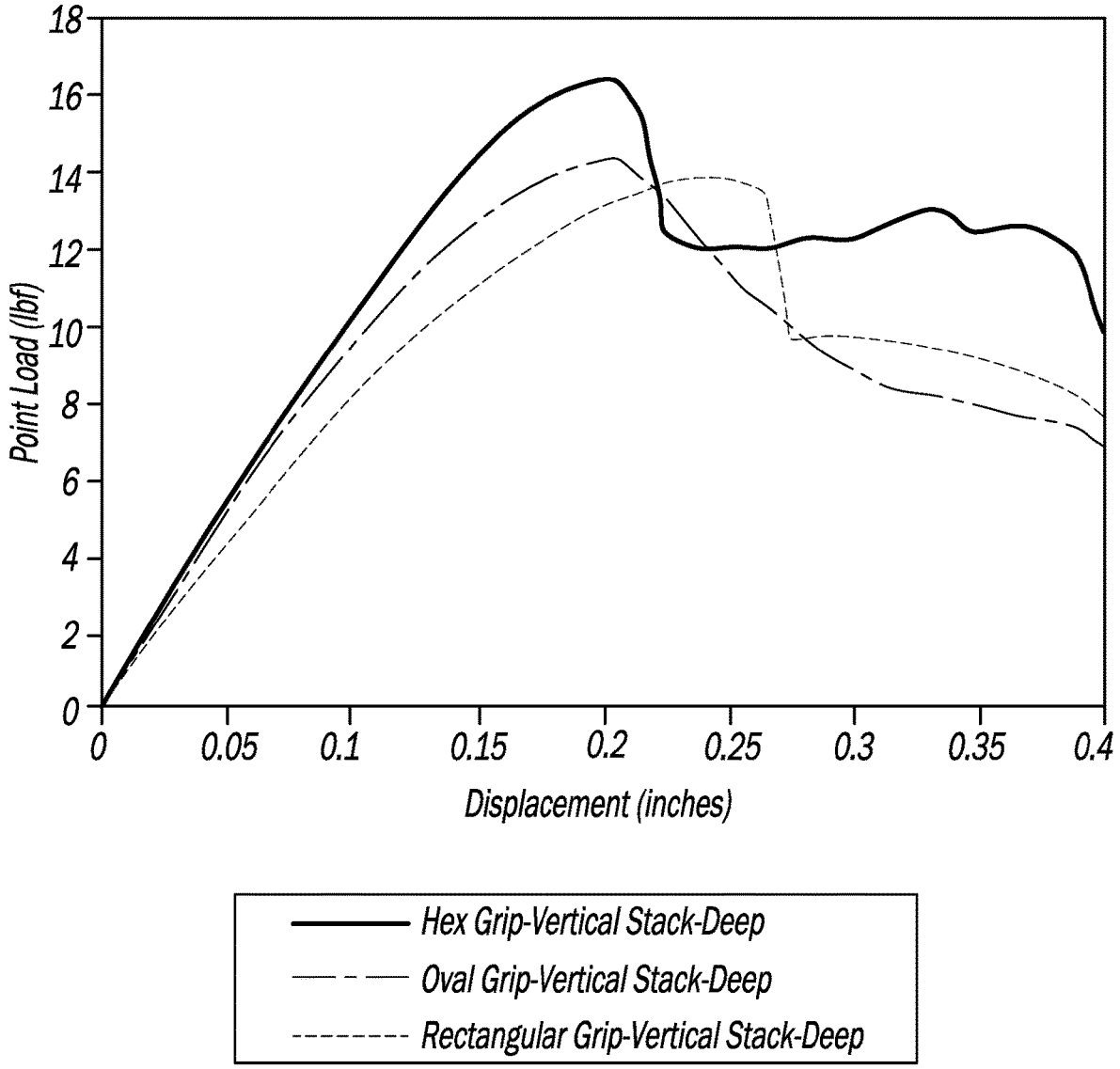
FIG. 8 illustrates point-load performance of additional exemplary containers of the present disclosure.

The grip areas 52 with the grip panels 60A, 60B, 60C advantageously increase the rigidity of the container 10 at the grip areas 52 by 30% or more as compared to existing containers, which advantageously increases the dent resistance of the container 10. With reference to FIG. 7, point-load performance of exemplary containers 10 in accordance with the present disclosure is illustrated. Containers 10 in accordance with the present disclosure were subjected to point-load testing. Point-load was simulated using FEA analysis to determine how much force in pounds it would take for a one inch round ball to displace/deform the grip area 52 a distance of 0.3 inches. As illustrated in FIG. 7, it took about 6-8 pounds of force to displace/deform the grip area 52 (of containers 10 having vertically aligned grip panels 60A, 60B, 60C) a distance of 0.3 inches, which means that the grip area 52 is able to withstand about 30% more point-load force than existing containers. FIG. 8 illustrates exemplary point-load performance of containers 10 having grip panels 60A, 60B, 60C that are vertically staggered. As illustrated in FIG. 8, it took about 12 pounds of force to displace/deform the grip area (of containers 10 having vertically staggered grip panels 60A, 60B, 60C) a distance of 0.3 inches. The grip panels 60A, 60B, and 60C also advantageously allow the polymeric material of the container 10 to have a lower material weight and lower thickness while maintaining acceptable point-load performance that resists denting at the grip area 52. One skilled in the art will appreciate that the present disclosure provides numerous additional advantages and unexpected results as well.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. A polymeric container comprising:

a finish defining an opening;

a base configured to support the container upright;

a grip area between the opening and the base, the grip area is a rigid panel, the grip area tapers inward towards a longitudinal axis of the container from a lower end of the grip area to an upper end of the grip area, the grip area includes a lower diameter at the lower end and an upper diameter at the upper end, the upper diameter is smaller than the lower diameter; and a plurality of grip panels at the grip area, each one of the grip panels having an oval shape, a depth defined by a continuous concave surface, a height, and a width, wherein the continuous concave surface extends between a bottom and a top of each one of the grip panels;

wherein the depth is at least 17% of the height;

wherein the depth is at least 10% of the width; and wherein the plurality of grip panels have a maximum load resistance greater than about 6 lbf.

2. The container of claim 1, wherein the plurality of grip panels are arranged in vertically aligned groups.

3. The container of claim 1, wherein the plurality of grip panels are arranged in vertically staggered groups.

4. The container of claim 1, wherein the plurality of grip panels have a maximum point load resistance greater than about 12 lbf.

5. The container of claim 1, wherein each one of the plurality of grip panels is surrounded by a border.

6. The container of claim 1, wherein the height is about 55% to about 65% of the width.

7. The container of claim 1, wherein the plurality of grip panels are arranged in 2-5 radial rows extending about a circumference of the container.

8. The container of claim 7, wherein each one of the radial rows include 5-7 of the plurality of grips.

9. The container of claim 1, the container having a volume of 20 oz to 30 oz.

10. A polymeric container comprising:

a finish defining an opening;

a neck and a shoulder extending from the finish;

an upper body portion extending from the shoulder;

a lower body portion extending from the upper body portion to a base of the container configured to support the container upright, the lower body portion is a rigid portion of the polymeric container, the lower body portion tapers inward towards a longitudinal axis of the container from a lower end of the lower body portion to an upper end of the lower body portion, the lower body portion includes a lower diameter at the lower end and an upper diameter at the upper end, the upper diameter is smaller than the lower diameter;

a plurality of grip panels at the lower body portion, each one of the plurality of grip panels having an oval shape, a depth defined by a continuous concave surface, a height, and a width, wherein the continuous concave surface extends between a bottom and a top of each one of the grip panels;

wherein the depth is at least 17% of the height;

wherein the depth is at least 10% of the width; and wherein the plurality of grip panels have a maximum load resistance greater than about 6 lbf.

11. The container of claim 10, wherein the plurality of grip panels are arranged in vertically aligned groups.

12. The container of claim 10, wherein the plurality of grip panels are arranged in vertically staggered groups.

13. The container of claim 10, wherein the plurality of grip panels have a maximum point load resistance greater than about 12 lbf.

14. The container of claim 10, wherein:

the plurality of grip panels are arranged in 2-5 radial rows extending about a circumference of the container;

each one of the radial rows has 5-7 of the plurality of grips; and the height is about 55% to about 65% of the width.

* * * * *